United States Patent [19]

Marlow

[11] 4,398,585

[45] Aug. 16, 1983

[54] THERMALLY EFFICIENT WINDOW SHADE CONSTRUCTION

[76] Inventor: Richard A. Marlow, 85 E. End Ave., New York, N.Y. 10028

[21] Appl. No.: 349,015

[22] Filed: Feb. 16, 1982

[51] Int. Cl.[3] ..... E04F 10/06

[52] U.S. Cl. ..... 160/23 R; 160/41; 160/271; 160/290 R

[58] Field of Search ..... 160/23 R, 41, 267-273, 160/290 R

[56] References Cited

U.S. PATENT DOCUMENTS

| | | | |
|---|---|---|---|
| 948,239 | 2/1910 | McManus | 160/41 |
| 983,104 | 1/1911 | Wilson | 160/41 |
| 2,325,992 | 8/1943 | Wirthman | 160/271 |
| 4,282,919 | 8/1981 | Teno | 160/23 R |
| 4,359,079 | 11/1982 | Bledsoe | 160/269 |

*Primary Examiner*—Peter M. Caun

*Attorney, Agent, or Firm*—Arthur B. Colvin

[57] ABSTRACT

The present invention relates to an improved thermal window shade construction characterized in that the same is sufficiently flexible to be installed in windows of a wide variety of sizes with a minimum number of stock parts. The invention is further characterized in that the shade is highly resistant to dislodgement in a lateral inward direction of the shade margins from the side seal components. A further characterizing feature of the invention resides in the novel mechanism which locks the shade in its downward or operative position and at the same time functions to form an effective top seal. Still a further characterizing feature of the invention resides in the ability of the stock parts supplied to form an effective sealing relationship with shades of a wide variety of thicknesses, whereby laminated shade constructions with desired decorative effects may be readily employed.

8 Claims, 6 Drawing Figures

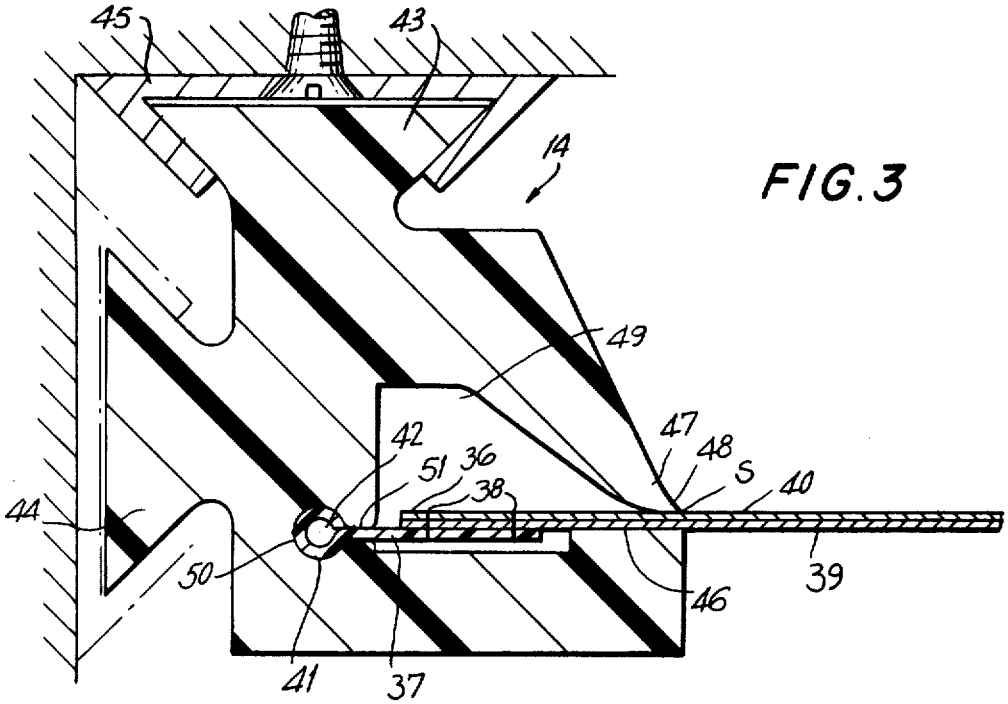
FIG. 3
FIG. 4
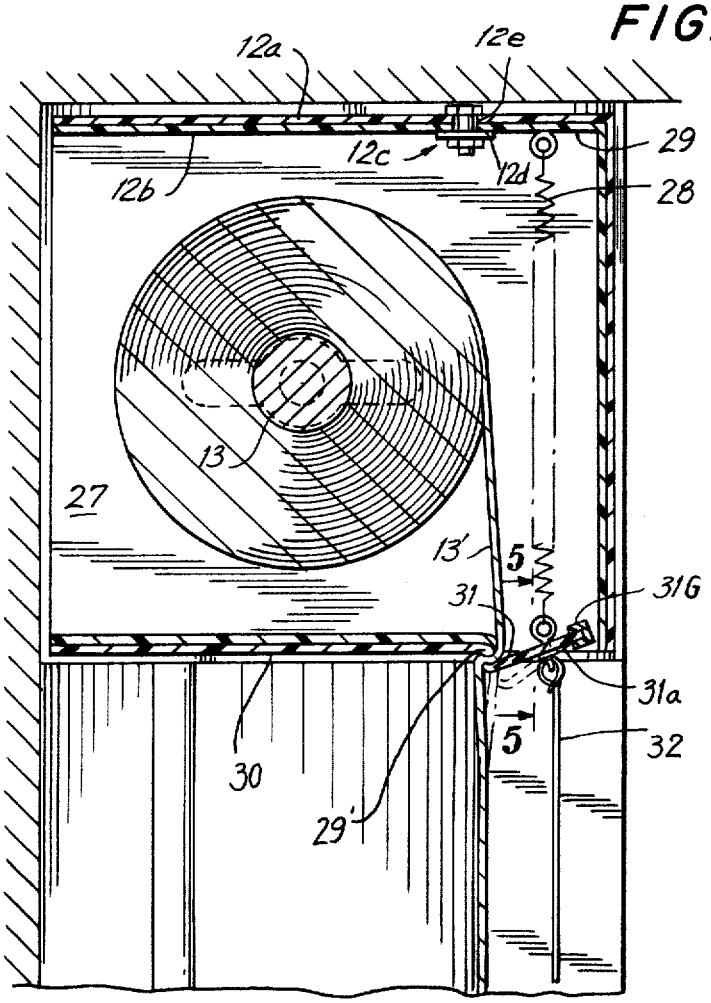
FIG. 5
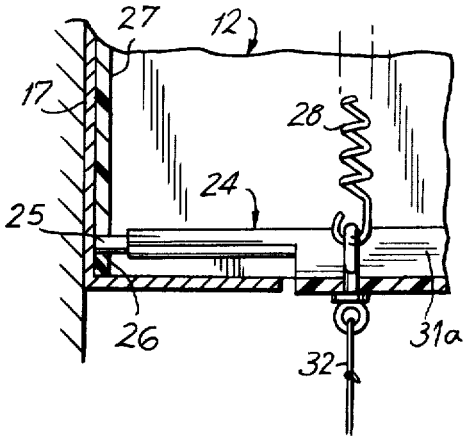

THERMALLY EFFICIENT WINDOW SHADE CONSTRUCTION

BACKGROUND OF THE INVENTION

The present invention relates to a window shade construction and more particularly to a window shade construction which provides significant advantages in the area of energy conservation. Still, more particularly, the invention relates to an energy saving window construction which is attractive and which is susceptible of being readily adapted for use with windows of a wide variety of sizes through the use of stock materials. The invention further relates to a window apparatus of the type described which is capable of use in conjunction with shade materials of a variety of thicknesses without loss of thermal efficiency.

THE PRIOR ART

It is known that windows are responsible for a high percentage of heat loss from dwellings, apartments and the like. It has been estimated that approximately 50% of the heat loss from such structures is through glass areas.

It has been proposed heretofore to provide an insulating shade structure which is mounted in spaced parallel relation to the window. When the shade structure is drawn, that is to say, in the window covering position thereof, there is provided a secondary barrier with the result that a volume of air is entraped between the window and the shade. The resultant structure reduces heat losses by minimizing convective, conductive and radiative heat transfer across the barrier provided by window and shade.

A principal difficulty inhering in thermal shade structures heretofore known resides in the fact that such units are necessarily customized for each installation with a resulting high initial cost. Further, in order to achieve a sliding seal between margins of the shade and portions of the shade guiding mechanism, reliance was placed on felt and similar wiper materials. Such materials not only provide a seal structure, which was compromised after repeated uses of the shade, but also necessitated even for an efficient initial seal that shade material of a predetermined and specific thickness be employed. Users of such shade structures thus were constrained to employ a limited range of fabrics or films as the shade material.

A further difficulty inhering in insulating shade structures heretofore known resided in the tendency of the shade edges to collapse or accordion inwardly and become disengaged from the guide track and side seal mechanism, responsive to pressures exerted centrally of the shade in the drawn condition. Even slight pressures exerted at a central area of the shade would shift the margins of the shade inwardly from the sealing tracks. Returning the edges to a properly seated condition in the tracks was a difficult task. As a means for avoiding unseating of the shade edges, typical practice involved placing the shade in a moving plane closely adjacent the window panes whereby pressures against the shade could deflect the shade only a limited distance insufficient to unseat the edges. However, by placing the shade close to the pane a great deal of the benefits of thermal isolation were lost due to the relatively short thermal bridge which resulted.

SUMMARY OF THE INVENTION

The present invention may be summarized as directed to an improved thermal insulating shade assembly characterized in that all of the components of the shade encompassing structure may be made from stock materials whereby a relatively limited number of stock size components may be utilized to thermally seal windows of a large variety of sizes. A further characterizing feature of the present invention resides in the side seal forming arrangement which enable stock size components to be used to effectively seal the side edges of shade materials of a variety of thicknesses. Such an arrangement provides the significant advantage of enabling laminated shade materials to be employed, whereby the thermal shade can become a decorative accessory readily coordinated to the decor of the room in which it is mounted.

Still a further advantage of the present invention resides in the provision of novel side seal portion including enlargements along the vertical edges of the shade margin. Such enlargements move within complemental recesses in the side sealing members with the result that the shade is highly resistant to unseating from the side seals responsive to pressures exerted against central portion of the shade in the drawn condition. The engagement of the enlargements with the recesses in the side guides has the further advantage of affording secondary seals whereby a double seal against the passage of air around the side margins of the shade is effected. Still a further advantage of the thermal shade apparatus of the present invention resides in the provision of a novel seal mechanism at the top of the shade assembly, whereby the same mechanism which resists rewinding of the shade also functions to assure a tight seal at the top edge of the shade.

It is accordingly an object of the invention to provide an improved thermally sealed shade adapted to be mounted over windows of a wide variety of sizes and utilizing a limited number of components of stock size. A further object of the invention is the provision of a shade structure of the type described which is highly resistant to unseating from the side guides provided therefor, either as a result of outward pressure against the shade or as a result of inward billowing wind forces exerted against the window adjacent face of the shade responsive to wind pressures. Still a further object of the invention is the provision of a shade assembly of the type described having a novel locking mechanism which retains the shade against rewinding to its convoluted condition and at the same time effects an efficient seal at the top margin of the shade.

In order to attain these objects and such other objects, as may be hereinafter pointed out, reference is made to the accompanying drawings wherein:

FIG. 3 is a magnified horzontal section taken on the line 3—3 of FIG. 1;

FIG. 4 is a magnified vertical section through the head of the shade assembly taken on the line 4—4 of FIG. 1;

FIG. 5 is a fragmentary vertical section taken on the line 5—5 of FIG. 4;

Figure 1:
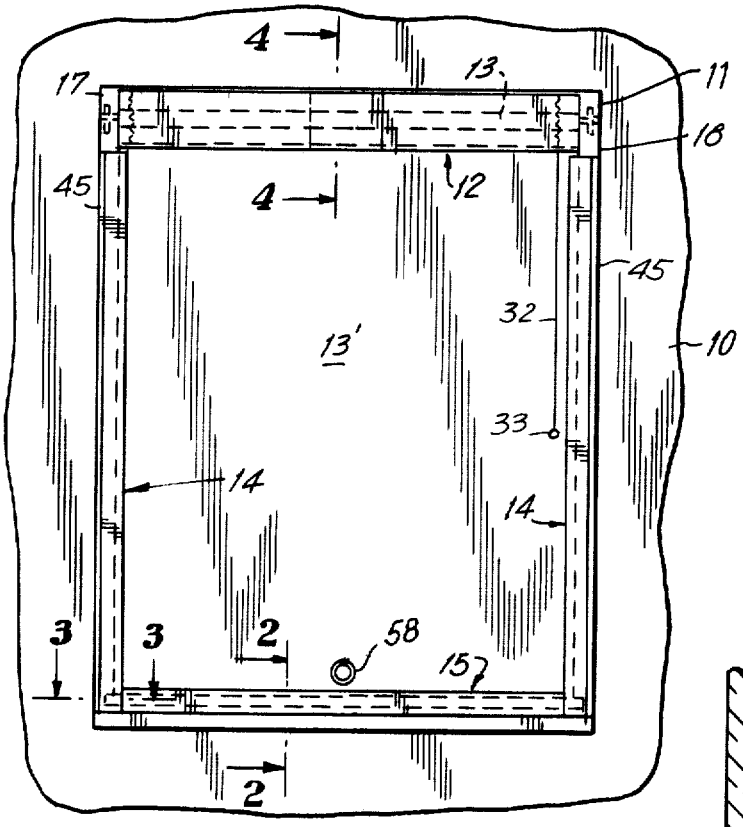
FIG. 1 is a front elevational view of a window assembly to which a thermal shade structure, in accordance with the invention has been applied.

Referring now to the drawings it is shown in FIG. 1 a wall section 10 having mounted therethrough an essentially conventional window 11, for instance a casement window. It will be readily recognized that the nature of the structure of the window is immaterial, i.e. any conventional vertical sliding or casement window may be accommodated.

Figure 6:
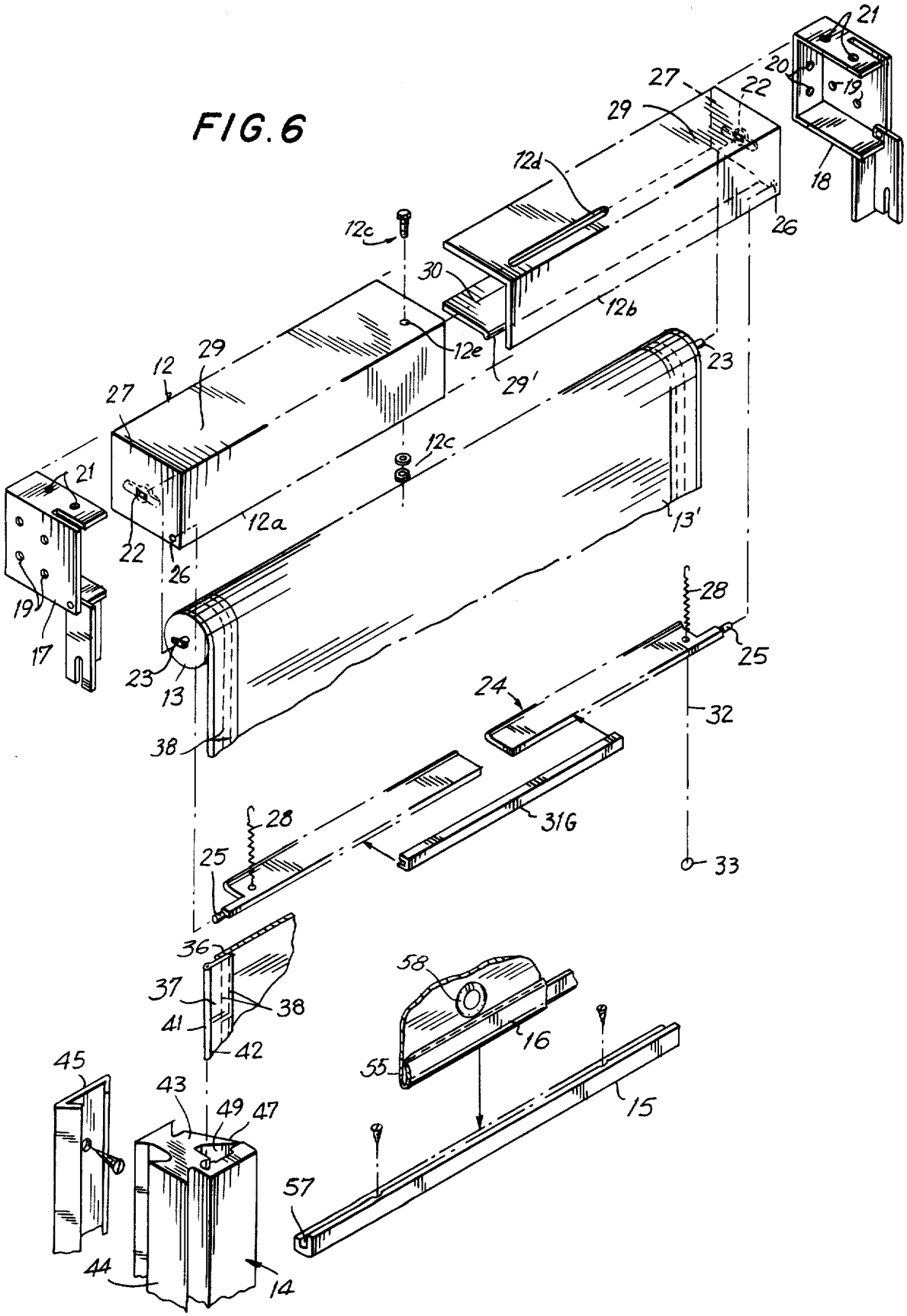
FIG. 6 is a isometric exploded view of various components of the shade construction.

The components of the shade assembly as may best be seen from FIG. 6, include a header box assembly 12 within which is housed the shade roller 13 carrying the shade 13'. The shade assembly includes side seal mechanisms 14, one such seal mechanism being located at each of the side marginal edges of the shade. A sill bar 15 is affixed to the window sill for receiving the base or draw bar 16 of the shade. The header box 12 is supported between a spaced pair of mounting fixtures 17, 18 of essentially conventional design. The fixtures of brackets 17, 18 may be mounted either to side wall portions through the use of mounting apertures 19 to a back wall portion through the use of mounting apertures 20 or to a ceiling support utilizing apertures 21.

The header box is preferably formed of two telescoping half sections 21*a*, 12*b* which slidably interfit and which may be adjusted to a range of lengthwise extents by adjustment bolt and nut assembly 12*c* extending through slot 12*d* in section 12*b* and aperture 12*e* in section 12*a*. The header box includes mounting slots 22—22 at the opposite ends thereof for receiving the rotors 23—23 of the shade in known manner. The mounting slots 22—22 and rotors 23—23 are eccentric i.e. are non-circular, whereby in the mounted condition the rotors may not revolve relative to the slots.

The shade roller 13 includes an internal spring motor of essentially conventional design whereby unreeling of the shade tensions the spring motor providing the same with the force necessary to reconvolute the shade when the shade is not impeded against upward movement. The motor mechanism of the shade of the instant invention differs from conventional such shade mechanisms, in that, the usual ratchet and pawl arrangement whereby the shade may be locked in intermediate positions is omitted. In other words, there is nothing within the shade motor mechanism to impede reconvolution of the shade, as is the case in conventional shade mechanisms.

The means whereby the shade is locked against an upward movement and is maintained in its downwardly drawn condition is spring shutter or blade member 24. The shutter member 24 includes end bearings 25—25, mounted in bearing apertures 26—26 in the end walls 27—27 of the header box. Preferably, the shutter is of a telescoping construction to enable it to follow the elongation characteristice of the header box.

A pair of spring members 28—28 are biased between the shutter at off center positions as respects the bearing portions 25, the upper ends of the springs 28 being secured to the top wall portions 29 of the header box. As best seen in FIG. 4, the shade 13' pays out of the header box adjacent a horizontally directed stop edge 29' on the end of floor portion 30 of the header box. The free edge 31 of the shutter 24 is normally biased toward the stop edge 29' by the lifting force of springs 28. It will thus be perceived that portions of the shade 14 disposed between stop edge 29' and the shutter will be pinched between such components under the lifting force of springs 28, which force is sufficient to prevent rerolling of the shade under the lifting forces of the spring motor. It will further be understood that, in addition to clamping the shade to assure against premature rerolling thereof, the described mechanism provides an effective seal between the opposed edges of the shade and the shutter on the one side and the stop edge on the other. The surface 31*a* of the shutter opposite surface 31 carries a resilient gasket 31G. In the clamped condition of the shade, the gasket is pivoted into engagement with a portion 29' of the floor of the header box to define a seal at the edge of the shutter remote from the shade engaging edge.

Means are provided for relieving the pressure of the shutter against the shade, such means comprising draw string 32 which depends from the shutter and is provided with pull knob 33. As will be apparent, downward pressure on the knob 33 will pivot the shutter in an anti-clockwise direction from the solid line to the dashed line position depicted in FIG. 4 in which latter position the shade will be free to return to its convoluted condition.

An important feature of the invention resides in the manner in which the side marginal edges of the shade are slideably and sealingly engaged by guide portions enveloping said edges. Referring, more particularly, to FIG. 3 it will be noted that each of the side marginal edges 36 includes an extension portion 37 affixed thereto as by bonding and or stitching, such as stitching 38. The shade itself may be comprised of a plurality of layers, such as an inwardly directed decorative layer 39 and a non-elongatable carrier layer 40. The extension portion 37 may include a loop or bight 41 within which is encompassed a flexible and preferably resilient enlarged portion 42.

The importance of the enlargement and the bight will be best recognized in connection with a description of the side guide members within which the margins of the shade are encompassed. The side guide members denoted generally as 14 are preferably formed of a resilient polymeric material such as vinyl chloride or the like. The guides 14 may be formed of an extrusion, said extrusion preferably incorporating two dovetail shaped mounting bases 43 and 44. The guides 14 are mounted by one or the other dovetails 43-44, being received within a complemental bracket member 45 adapted to be fixed either to wall parallel with the window, as shown in solid lines in FIG. 3, or where the apparatus is to be installed within a window opening to the wall perpendicular to the window pane for encompassing the dovetail structure 44.

The guide members 14 include an outwardly facing, vertically extending stop abutment 46 which by virture of the thickness of the section is relatively rigid. Opposite the abutment surface 46 and integral with the side member 14 there is formed a resilient vertically extending wiper finger 47. The finger 47 includes a reduced thickness lip portion 48.

The extruded members 14 are so formed that the natural postion of the lip 48 is in lightly biased engagement against the surface 46. It will be thus perceived that when a thickness or thicknesses of shade are interposed between the abutment 46 and lip 48 a wiping pressure is exerted against the opposed faces of the shade whereby an effective weather seal is formed. It will be further appreciated that the seal is essentially independent of the thickness of the shade i.e. a seal is provided whether a thicker or an thinner shade is employed.

As best seen in FIG. 3, the side members 14 include a recess or cavity 49 inwardly of the seal area S defined between surfaces 46 and 48. The members 14 are provided with a still further vertically extending recess 50 within which the enlargement portion 41 of the shade is slideably mounted. The enlargement 50 is separated from cavity 49 by a non-reentrant neck portion 51 of lesser dimension than the enlargement portion 41 of the shade.

As will be readily recognized, the encompassing of the enlargement 41 of the shade within the recess 50 and the narrowed neck portion 51 will result in the provision of an effective resistance against lateral movement of the shade margins out of the guides 14. That is to say, a very substantial force must be exerted before the margins of the shade can be pulled inwardly free of the guides. This arrangement enables the shade to be spaced a substantial distance inwardly of the window whereby a more efficient insulating action is achieved then would be the case if the shade and panes were in close proximity.

Figure 2:
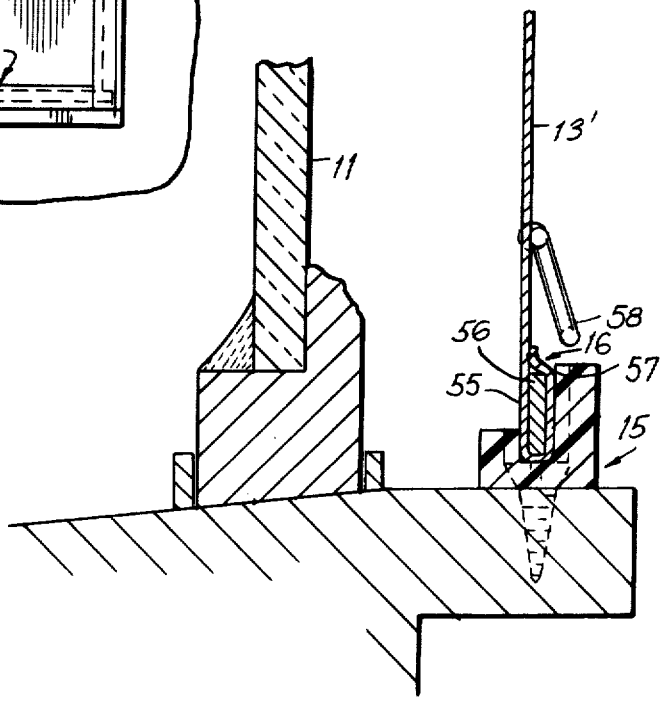
FIG. 2 is a magnified vertical section taken on the line 2—2 of FIG. 1.

The shade includes at its bottom edge 16 a horizontally extending enlargement portion which may comprise a loop or convolution 55 surrounding a horizontally directed rigid slat 56. The combined thickness of the loop 55 and slat 56 is accommodated in an upwardly directed slot 57 formed in the sill piece 15. See FIG. 2. The sill piece 15 may be comprised of a polymeric extrusion whereby, due to the resiliance of the polymeric material, an intimate embracing action of the sill piece about the lower edge portion of the shade may be accomplished providing a tight seal at the bottom of the shade.

Optionally, in order to facilitate drawing of the shade a ring member 58 may be fastened to the shade.

The manner of installation and operation of the described device will be apparent from the preceeding explanation.

The purchaser must first select a head assembly 12 which is approximately of an appropriate size for the window to be treated. The assembly 12 is adjusted to a desired telescoped length by sliding movement of the portions 12*a*, 12*b* and locked in the desired relation by fastener assembly 12*c*. It will be apparent that a degree of overlap beyond the window construction proper will not impede the satisfactory operation of the apparatus.

The side guides 14 and the brackets 45 may be made available in overlength sized and cut to length by the installer or optionally may be supplied in sizes appropriate to windows of particular vertical extents. Similarly, the sill piece 15 comprising a polymeric extrusion may be severed from stock lengths or supplied in cut to size dimensions for conventional sized windows.

Installation of the apparatus is effected by mounting the header support brackets 17–18, either to a upper framing component of the window or to a back wall portion. The side guide support brackets 45 are similarly mounted either to a side wall portion or a back wall portion in accordance with the dictates of a particular window installation. The sill piece 15 is mounted with its upwardly facing slot in registry with the gap between the wiper finger 48 and the abutment stop 46 of the side guides 14. As noted the shade member S may be comprised of single thickness or laminated structure, the latter structure being preferred since numerous decorative effects may be achieved in accordance with the texture and color of the laminated overlayer applied.

In the raised or fully convoluted condition of the shade, the framing structure does not materially intrude into the room decor and, of course, the shade itself is essentially fully housed within the header member. When it is desired to shift the shade into its insulating or operative position, it is merely necessary to grasp the ring 58 and draw the shade downwardly against the tension of the spring motor until the lower slat of enlarged portion of the shade rests within the upwardly facing slot 57 in the sill piece 15. In such position it will be perceived that a complete and effective seal is defined by the shade within the various described framing components.

The seal at the bottom is defined by the engagement of the sill piece about the enlarged lower edge of the shade. At the sides a double sealing effect is achieved both by the wiping contact of the resilient portions of the polymeric material of the side pieces 14, adjacent the margins of the shade and by the further sealing effect achieved as a result of the engagement of the enlarged portions 42 at the marginal edges of the shade in the vertically directed passages 50 in the side pieces 14. Further, in the operative condition of the shade an effective top seal is achieved as a result of the pressure of the shutter member 24 against a horizontally directed portion of the shade tending to press the engaged portion against a fixed part of the header assembly as previously described.

The shade will be retained in its described lowered or operative position by the continued pressure of the shutter against the shade. When it is desired to shift the shade to its raised or inoperative position it is merely necessary to pull the cord 32 downwardly pivoting the shutter away from its contacting relation with the shade whereupon the shade will be reconvoluted by the action of the spring motor.

From the foregoing description it will be evident that there has been described in accordance with the present invention an improved thermal shade construction characterized in that a relatively limited number of component parts is necessary to enable the same to be adapted to any of a wide variety of window sizes. The header assembly may be laterally extended with a substantial range of adjustment as a result of the telescoping connection between the header components.

The side pieces and the sill pieces may be readily mounted and may be readily cut to any particular size window through the use of simple hand tools, since they are preferably made of polymeric material. Additionally, due to the resiliency of the side pieces any of a wide variety of thickness shade materials may be utilized without sacrificing the efficiency of the side seal.

As will be apparent to those skilled in the art and familarized with instant disclosure numerous variations in details of construction may be made without departing from the spirit of the invention. Accordingly, the invention is to be broadly construed within the scope of the appended claims.

The embodiments of the invention in which an exclusive property or privilege is claimed are defined as follows:

1. A thermal isolating shade assembly comprising in combination, a header box, a roller shade member mounted in said box, for movement between extended and convoluted positions, said shade being normally urged to said convoluted position, an access slot formed in the bottom of said box, said shade projecting downwardly through said slot, a shutter blade mounted to said box, said blade extending a transverse distance substantially coextensive with the width of said shade, and including a seal surface movable toward and away from said slot, spring means yieldingly urging said blade toward said slot to thereby clamp substantially the entirety of the width of said shade between a wall defining said slot and said seal surface to define a transverse seal area with said shade and clamp said shade against movement from said extended to said convoluted position, and release means operatively connected to said shutter manually actuable to shift said shutter away from said slot to thereby release said shade for return movement to said convoluted condition.

2. Apparatus in accordance with claim 1, wherein said shutter blade is pivotally mounted to said box and said release means comprises a pull cord.

3. Apparatus in accordance with claim 1 and including a pair of vertically directed side guide members disposed below said box and adapted in the extended position of said shade member to define vertical seals with the edges of said shade, said side guide members each being formed of resilient polymeric material and including a vertically directed channel, having a laterally inwardly opening mouth portion, said mouth portions being defined by a relatively rigid backing face and a lip member resiliently urged toward said backing face, said side edges of said shade, in said extended position being pinched between said backing faces and said lips to thereby define said vertical seals.

4. Apparatus in accordance with claim 3 wherein said side edges of said shades include longituainally extending enlargements, and said channels of side guide members include vertically directed recess portions laterally outwardly spaced with relation to said mouth portions, said recess portions being of non-reentrant configuration and partially encircling said enlargements, whereby, in the extended position of said shade, said edge portions are constrained against inward movement by the interaction of said enlargements and said recess portions.

5. Apparatus in accordance with claim 4 wherein said enlargements and recess portions define secondary seals whereby double seals are formed at the side edges of said shade in said extended position.

6. Apparatus in accordance with claim 5 and including a horizontally directed receiver channel below said box, said channel forming a seal with the free edge of said shade in said extended position.

7. Apparatus in accordance with claim 1 wherein said header box is laterally adjustable to thereby accomodate shades of a variety of widths.

8. Apparatus in accordance with claim 1 wherein the surface of said shutter blade opposite said seal surface includes a resiliently compressably gasket member, said gasket member, in the clamped condition of said shade being biased against portions of said header box to define a seal between said blade and box.

* * * * *